US007462138B2

(12) United States Patent
Shetty et al.

(10) Patent No.: US 7,462,138 B2
(45) Date of Patent: Dec. 9, 2008

(54) AMBULATORY SUSPENSION AND REHABILITATION APPARATUS

(75) Inventors: Devdas Shetty, West Hartford, CT (US); Avital Fast, Glen Cove, NY (US); Claudio Campana, Suffield, CT (US)

(73) Assignees: The University of Hartford, West Hartford, CT (US); Montefiore Medical Center, Bronx, NY (US)

( * ) Notice: Subject to any disclaimer, the term of this patent is extended or adjusted under 35 U.S.C. 154(b) by 768 days.

(21) Appl. No.: 11/173,197

(22) Filed: Jul. 1, 2005

(65) Prior Publication Data

US 2007/0004567 A1 Jan. 4, 2007

(51) Int. Cl.
*A63B 22/00* (2006.01)

(52) U.S. Cl. ..... 482/69; 482/51; 601/23

(58) Field of Classification Search ..... 482/51, 482/54, 55, 66–69; 601/1, 5, 23; 5/81.1 R, 5/83.1; 212/327, 336

See application file for complete search history.

(56) References Cited

U.S. PATENT DOCUMENTS

| | | | |
|---|---|---|---|
| 3,252,704 | A | 5/1966 | Wilson |
| 3,721,436 | A | 3/1973 | Barthel, Jr. |
| 3,780,663 | A | 12/1973 | Pettit |
| 4,243,147 | A | 1/1981 | Twitchell et al. |
| 4,252,063 | A | 2/1981 | Brooks, Jr. |
| 4,256,098 | A | 3/1981 | Swan et al. |
| 4,445,502 | A | 5/1984 | Swan et al. |
| 4,973,044 | A | 11/1990 | Jones |
| 5,158,188 | A | 10/1992 | Nordberg |
| 5,337,908 | A | 8/1994 | Beck, Jr. |
| 5,456,655 | A | 10/1995 | Morris |
| 5,499,408 | A | 3/1996 | Nix |
| 5,623,948 | A | 4/1997 | Van Morris |
| 5,809,591 | A | 9/1998 | Capaldi et al. |
| 5,952,796 | A | 9/1999 | Colgate et al. |
| 5,996,823 | A | 12/1999 | Dyson |
| 6,079,578 | A | 6/2000 | Dyson |
| 6,080,087 | A | 6/2000 | Bingham |
| 6,241,462 | B1 | 6/2001 | Wannasuphoprasit |
| 6,244,991 | B1 | 6/2001 | Bingham |
| 6,315,138 | B1 * | 11/2001 | Dyson ..... 212/336 |
| 6,523,195 | B1 | 2/2003 | Rodier et al. |

(Continued)

OTHER PUBLICATIONS

Z Lift Incremental Body Weight Support System Manufacturers' brochure = Z-Lift Corporation Austin, Texas.

(Continued)

*Primary Examiner*—Glenn Richman

(57) ABSTRACT

An ambulatory suspension system for gait rehabilitation has a parallel pair of rails bordering the sides of a training area and a bridge extending between and movable along the rails. A trolley is movable along the bridge and includes a motor driven hoist with a cable extending thereabout and depending from the trolley. The hoist is operable to vary the length of the cable depending from the trolley, and a harness is suspended by the cable. Motors move the bridge along the rails and the trolley along the bridge as the sensors sense the direction of movement of the patient in X and Y directions. The falling motion of a patient supported in the harness is sensed and will immediately disable the system. A computer control receives signals from the sensors and operates the motors so that the patient is held in an upright position.

20 Claims, 22 Drawing Sheets

U.S. PATENT DOCUMENTS

| | | | | |
|---|---|---|---|---|
| 6,689,075 | B2 * | 2/2004 | West | 601/23 |
| 7,381,163 | B2 * | 6/2008 | Gordon et al. | 482/69 |
| 2001/0027149 | A1 | 10/2001 | Bingham | |
| 2003/0162636 | A1 | 8/2003 | West | |
| 2004/0031096 | A1 | 2/2004 | Liljedahl | |

OTHER PUBLICATIONS

Biodex Unweighing Harness Operation Biodex Medical Systems, Shirley, New York Manual.
Motorised Overhead Harness—Monash Rehabilitation Technology Unit Monash University Publication.

* cited by examiner

MAIN STRUCTURE

OPERATIONAL FLOW CHART OF AMBULATORY SUSPENSION SYSTEM

THE ALGORITHM IS WRITTEN WITH A VISUAL SIMULATION PROCEDURE USING WINDOWS APPLICATION SOFTWARE. THE PROCEDURE IS COMPLETELY BLOCK DIAGRAM BASED.

(LEGEND)

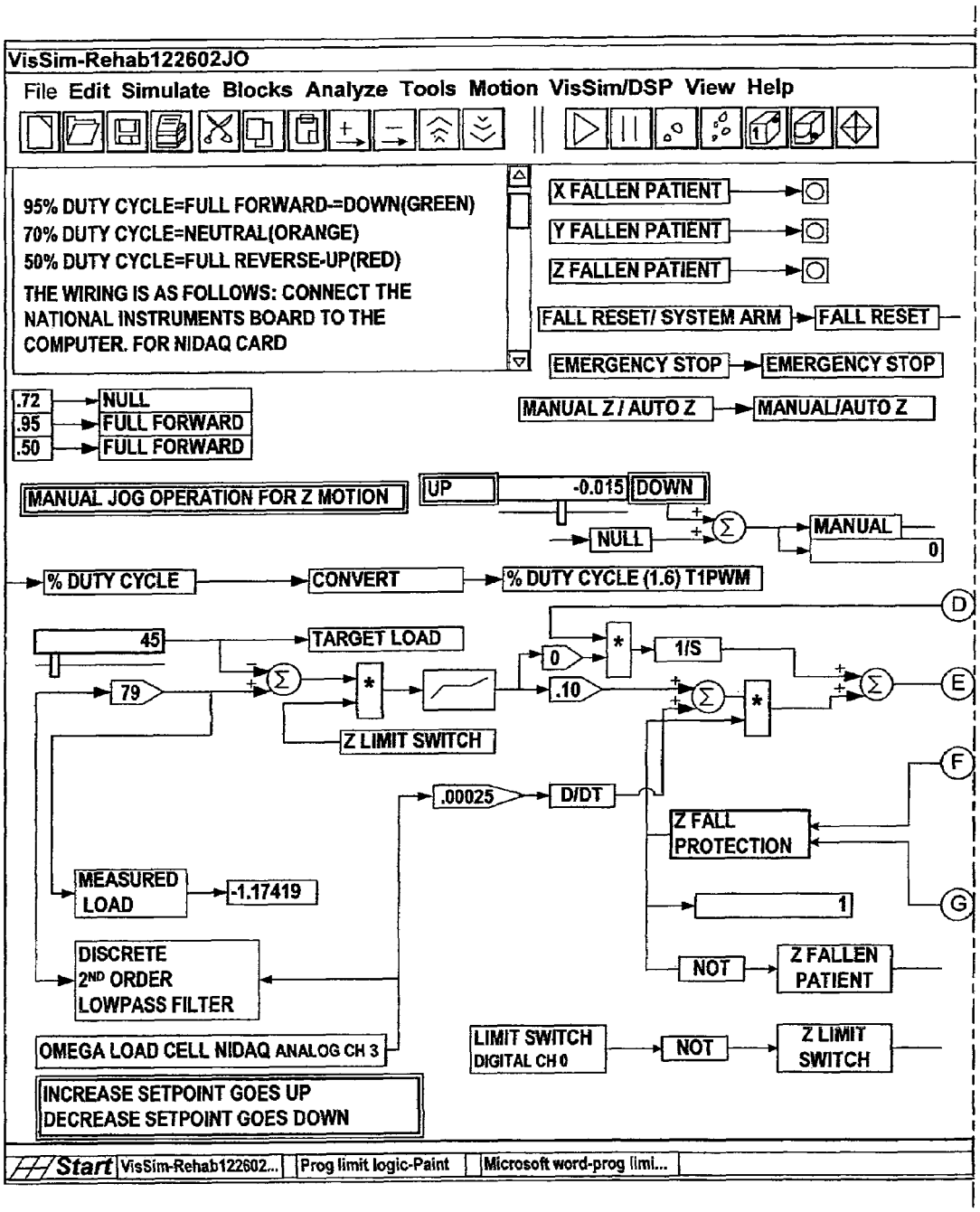
FIG. 11A(1)

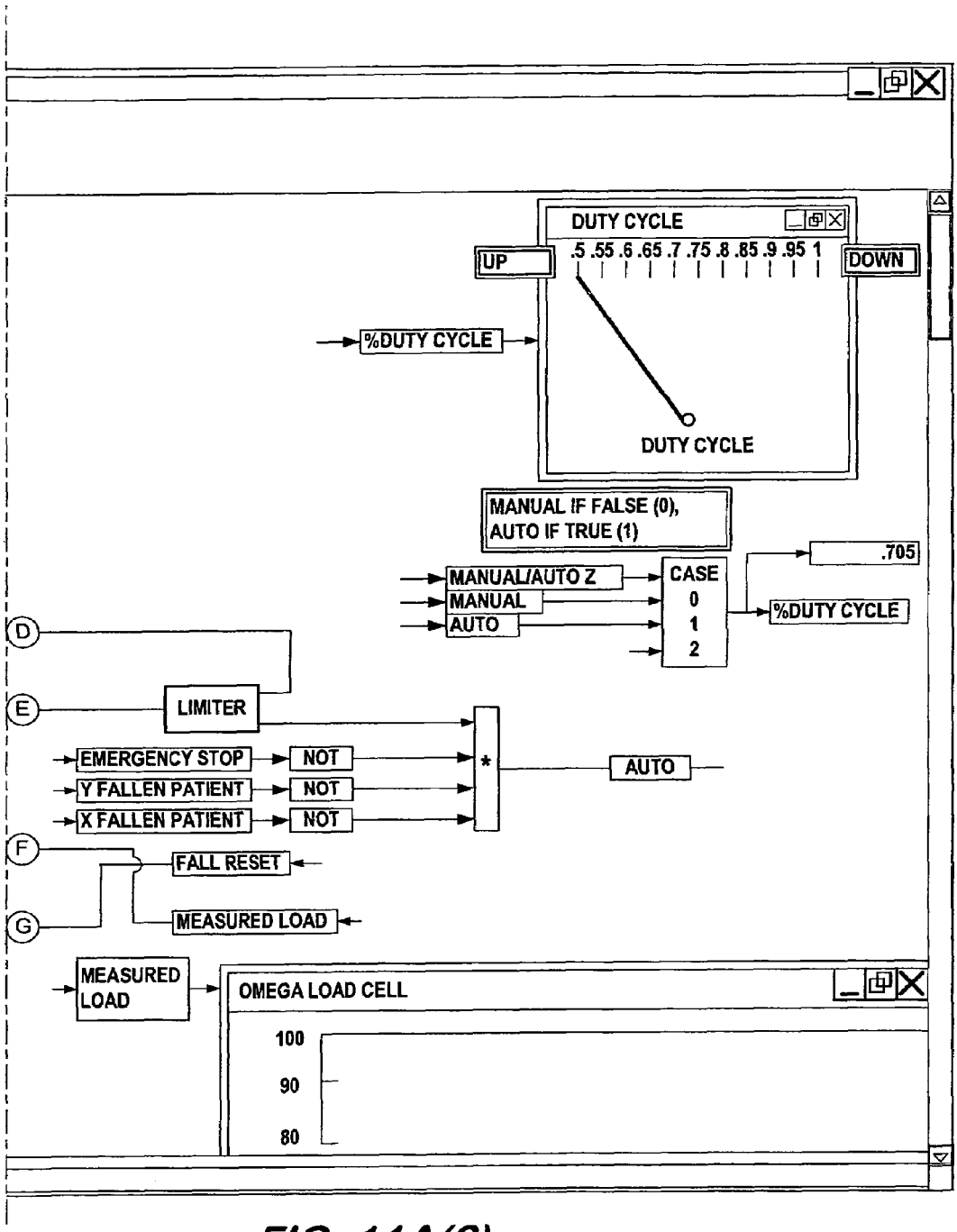
FIG. 11A(2)

(LEGEND)

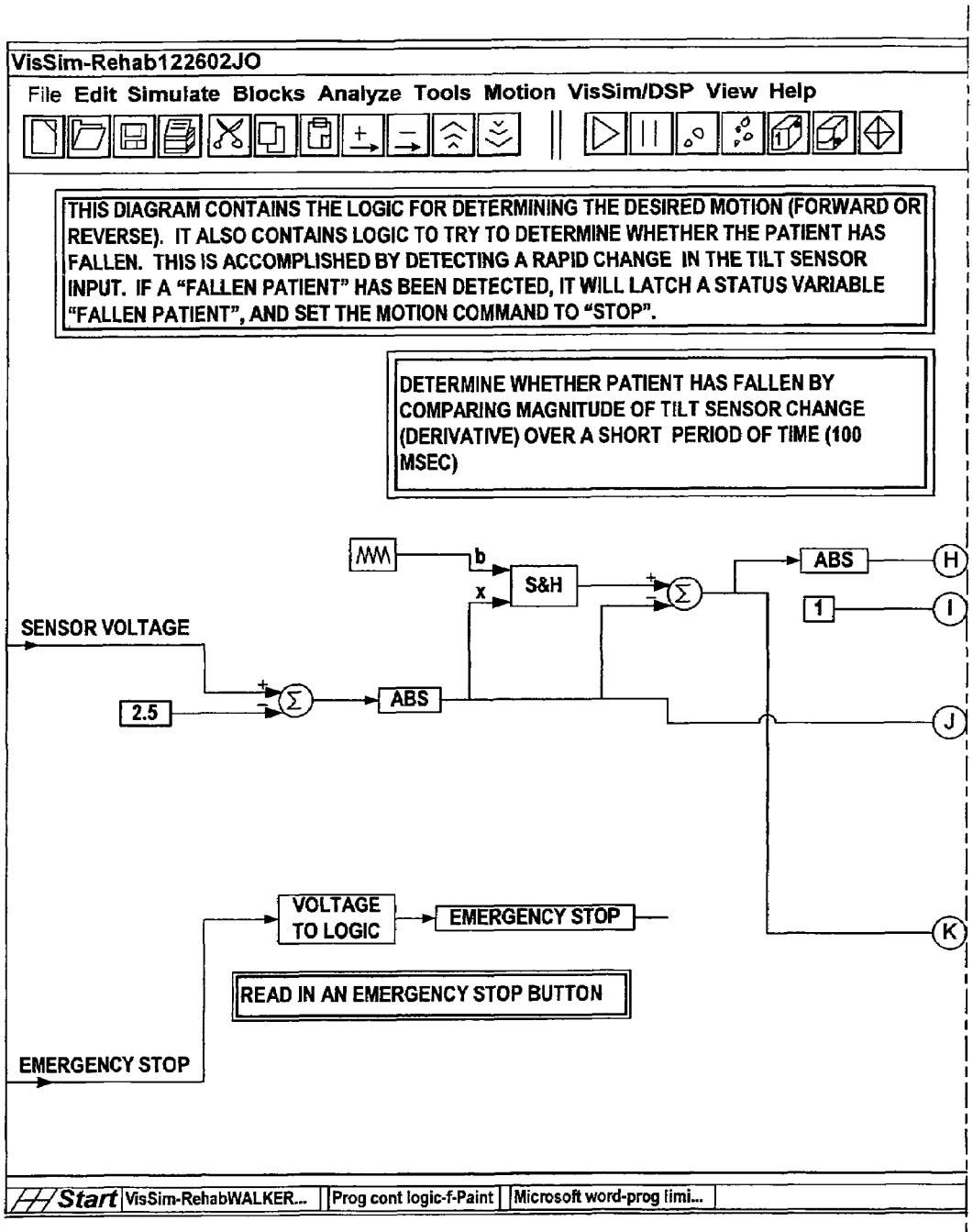
FIG. 11B(1)

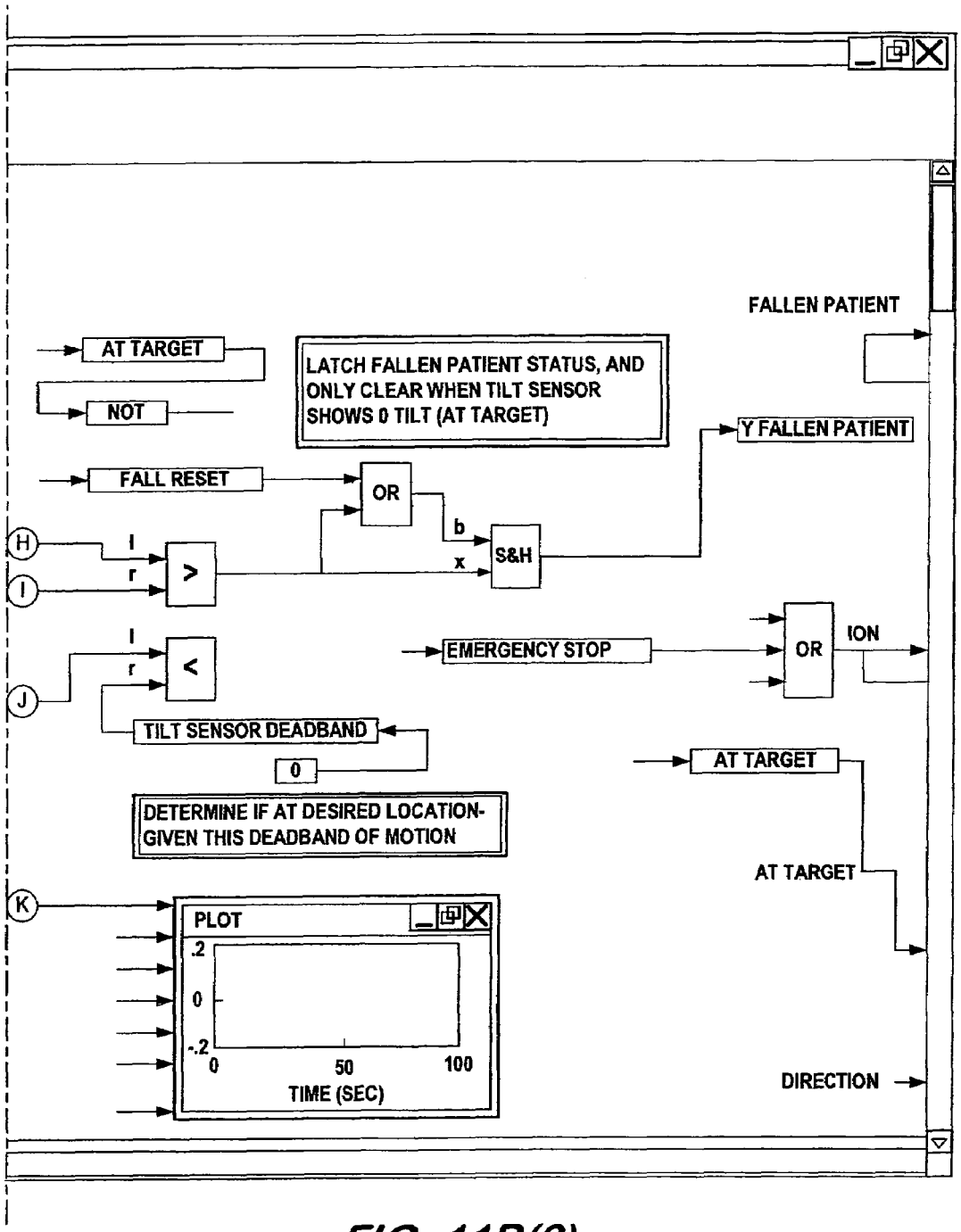
FIG. 11B(2)

(LEGEND)

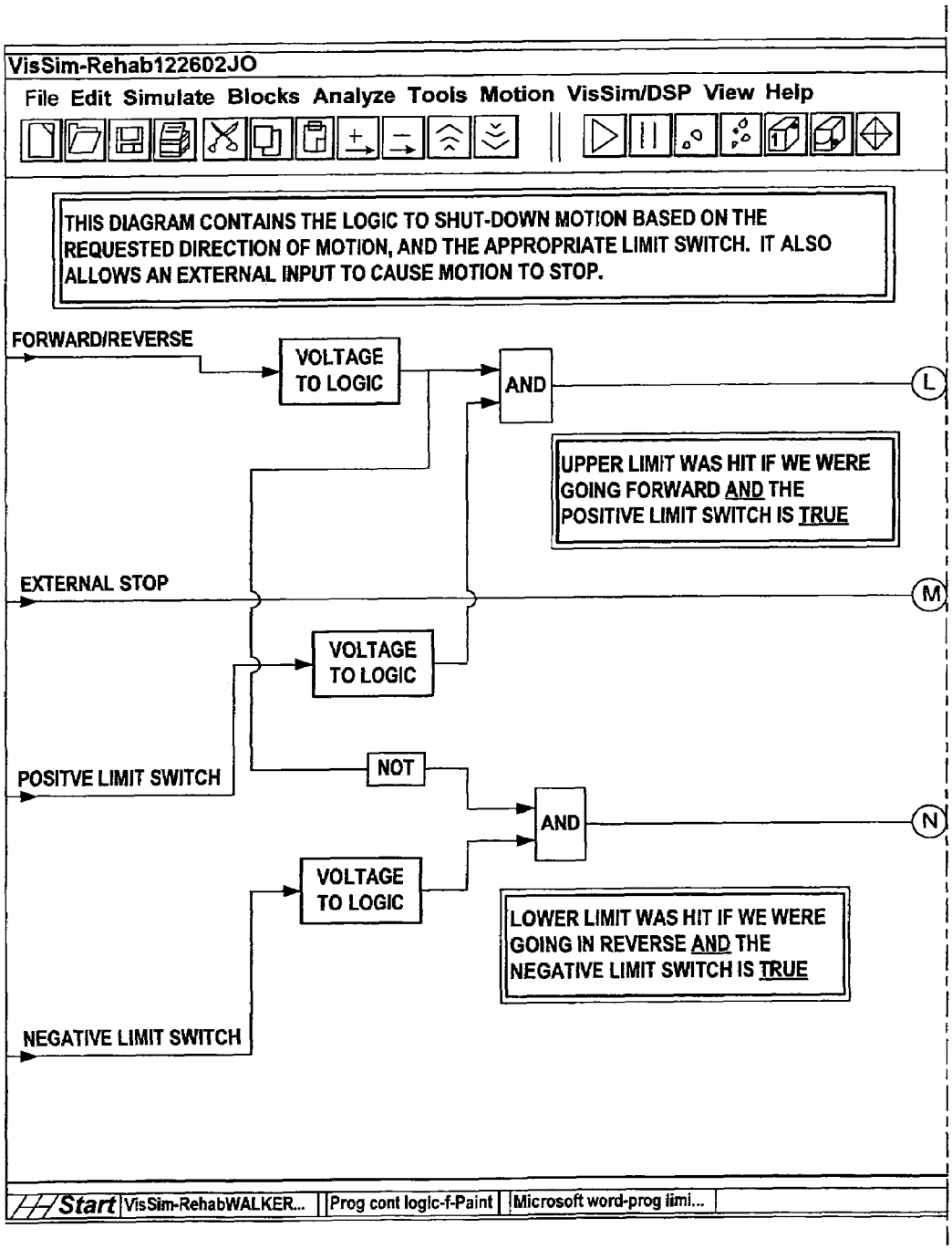
FIG. 11C(1)

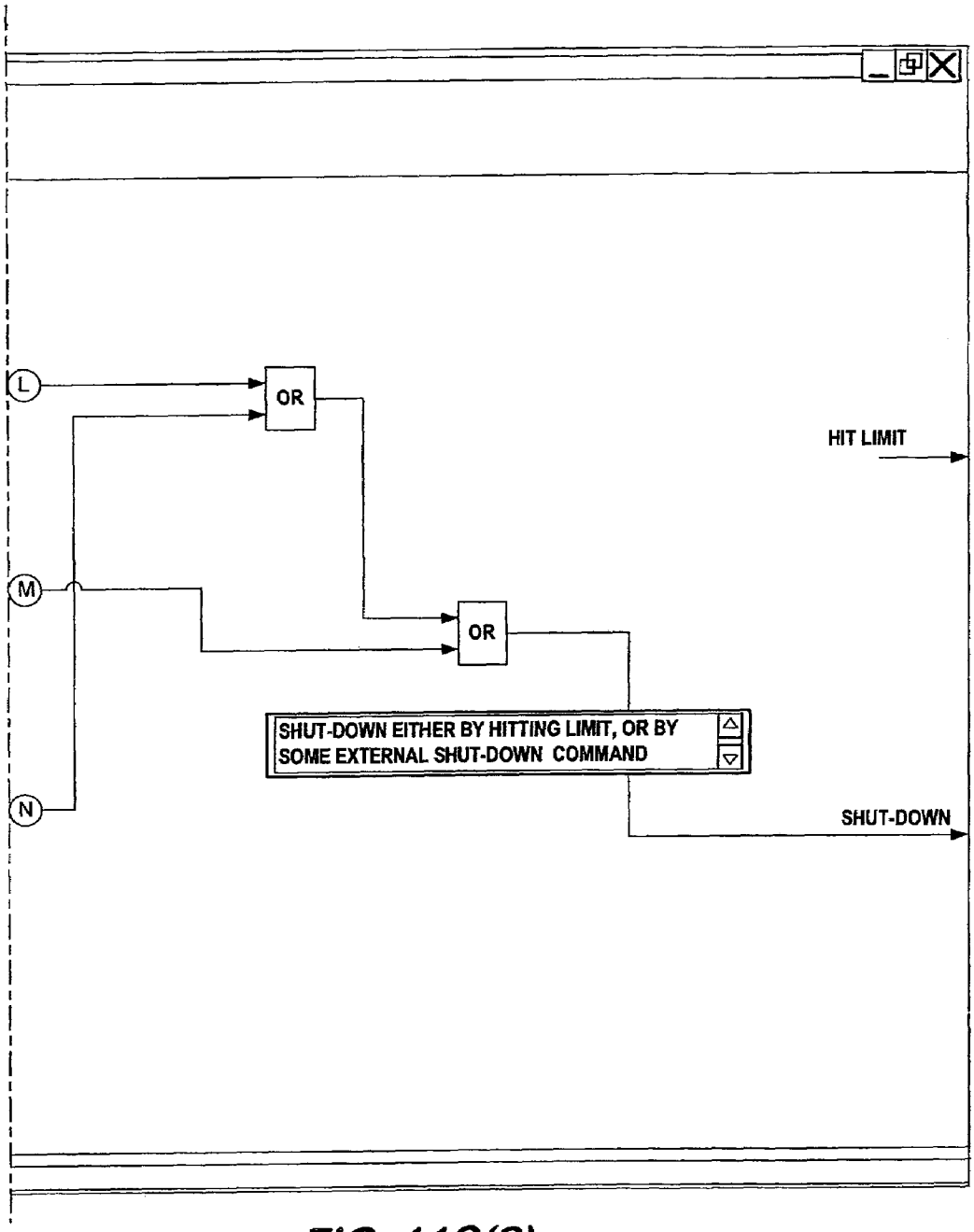
FIG. 11C(2)

AMBULATORY SUSPENSION AND REHABILITATION APPARATUS

BACKGROUND OF THE INVENTION

The present invention relates to ambulatory suspension systems for use during therapy.

Ambulatory suspension systems are used to assist the therapist during gait therapy of patients. These systems allow patients to gain strength and confidence by offsetting a percentage of body mass and providing balancing support. Such suspension systems provide incremental body weight support and primarily focus on gait training. The main application of these systems is to help patients who are unable to support their own weight and thus ambulate without assistance. Partial weight bearing devices are also used by patients to assist in ambulatory movement, by patients with spinal cord injuries, and by patients who lack upper body strength to support themselves.

In the field of gait therapy and balance training, there have been examples of the usage of partial weight bearing devices. These devices facilitate walking of patients in the early stages of neurological recovery.

An incremental body weight support system sold by Z Lift Corporation of Austin, Tex. utilizes a support system that allows for change in the amount of body weight supported while the patient is exercising.

An unweighting harness operation system sold by Biodex Medical Systems of Shirley, N.Y. uses similar principles, and is used during partial weight bearing gait therapy of patients as they relearn walking functions.

A motorized overhead harness system of similar nature has been proposed by Monash University and can be used for safety and weight relief during early stages in the rehabilitation of patients with gait disorders. This system has been experimentally used with patients who need amputee rehabilitation.

Colgate et al U.S. Pat. No. 5,952,796 shows easy lifting by devices known as Cobots. These devices are applied for direct physical interaction between a person and a general purpose robot manipulator. This specific apparatus is also known as a collaborative robot and may assume several configurations common to conventional robots.

Wannasuphoprasit et al U.S. Pat. No. 6,241,462 shows a mechanical apparatus with a high performance for raising and lowering a load and controlling the so that its operation is responsive to and intuitive for a human operator.

All of these systems can provide some weight bearing relief during ambulatory movement. However, none of the systems allows free ambulatory movement in all directions. None of these systems can continuously monitor the axial load and sudden force changes in different directions indicating a patient falling. Slips and falls remain one of the leading losses in worker compensation claims in the United States and worldwide. Falls may lead to significant morbidity (hip and pelvic fracture) and possibly death. Suspension devices that can help patients during exercise sessions of stair climbing are not presently available.

It is an object of the present invention to provide a novel ambulatory suspension system that can monitor and prevent the fall of the patients during rehabilitation and exercise.

It is also an object to provide a novel apparatus that the users can use to freely move in planar region and climb up and down a number of stairs.

A further object is to provide such a system which can also be used as a teaching device for ambulatory training, and to improve balance and increase safety during ambulatory movement and stair climbing.

SUMMARY OF THE INVENTION

It has now been found that the foregoing and related objects may be readily attained in an ambulatory suspension system for gait rehabilitation including a parallel pair of rails bordering the sides of and spaced above a training area, and a bridge extending between and movable along the rails. A trolley is movable along the bridge and a motor driven hoist on the trolley has a cable extending thereabout and depending therefrom. The hoist is operable to vary the length of the cable depending from the trolley, and a harness is suspended on the cable for supporting the patient.

Motors move the bridge along the rails and the trolley along the bridge, and sensors sense the direction of movement of the patient in X and Y directions. A sensor on the cable senses the falling motion of a patient supported in the harness.

A computer control receives signals from the sensors and operates the motors to move the bridge on the rails and the trolley on the bridge and to actuate the hoist to provide movable support for the patient in the harness within the training area.

Preferably, the X and Y direction sensoring is provided by a dual axis tilt angle sensor which is supported on the depending cable, and the falling motion sensor is a load cell. Desirably, the motor for moving the bridge drives a belt extending along one of the rails, a second drive belt extends along the other of the rails, and a transmission couples the belts to effect simultaneous motion of the belts and thereby both ends of the bridge.

The falling sensor also maintains a desired load for unweighting the patient, and the computer responds to the patient's movement in X and Y directions and effects the intended unweighting in the Z direction.

Desirably, a panic button is provided to instantly stop and lock the system and the position of the patient in the support in the event of a system failure. The computer control defaults to a locked position in the event of a power failure so that the patient does not fall.

The computer control includes a memory which stores patient data as well as the requirements in the patient's training program. The computer control is fully automated under normal conditions and does not require continuous patient supervision after initial equipment setup. The computer control is responsive to input from the falling motion sensor to maintain essentially the same unweighting of the patient during movement up and down stairs.

Desirably, the drive motor for the trolley is engaged with a drive belt extending along the length of the bridge.

DETAILED DESCRIPTION OF THE PREFERRED EMBODIMENT

Figure 1:
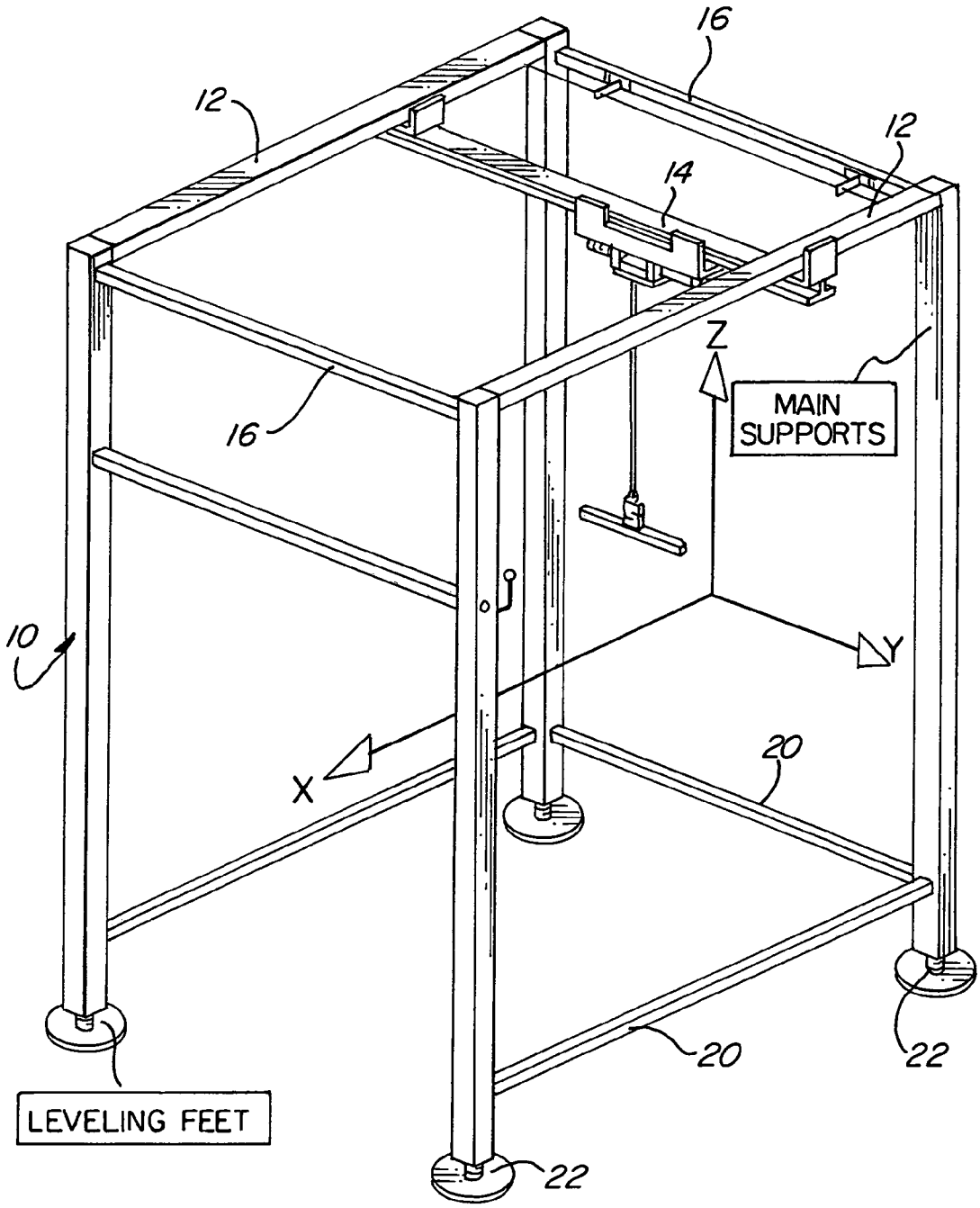
FIG. 1 illustrates the framework for a gait rehabilitation system embodying the present invention.

Turning first to FIG. 1, a floor supported framework generally designated by the numeral 10 includes a pair of spaced rails 12*a*, 12*b*, a bridge 14 extending between and movably supported on the rails 12, transverse end frame members 16, corner posts 18 and tie members 20. The feet 22 at the base of the posts 18 are adjustable for leveling the framework 10 on a support surface.

Figure 2:
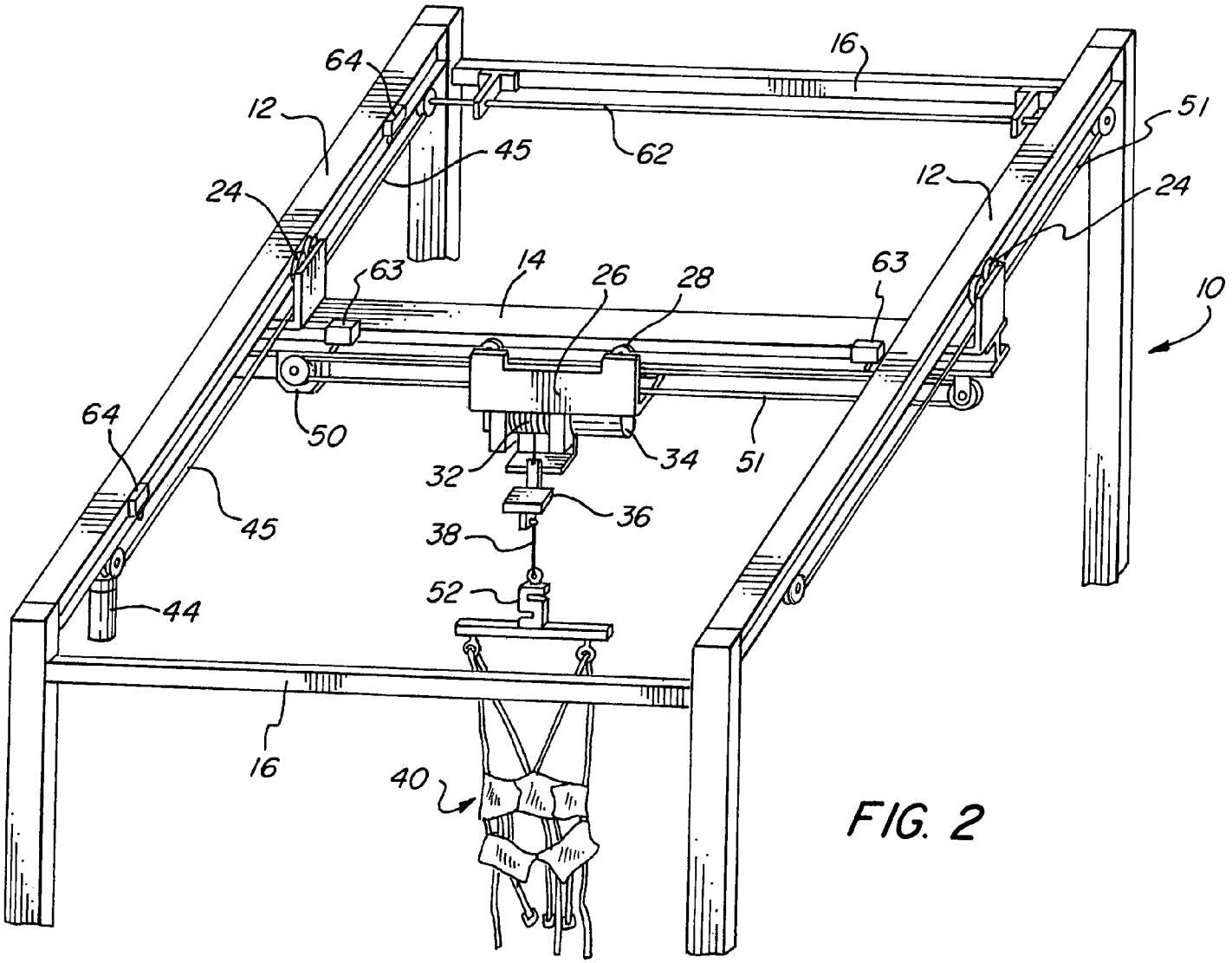
FIG. 2 is a fragmentary perspective view of the framework with elements of the system including the body harness supported on the trolley.

As seen in FIG. 2, the bridge 14 has rollers 24 at its ends which roll on the rails 12. Both the rails 12 and the bridge 14 are designed as I-beams providing the track surfaces. Movably supported on the bridge 14 is a trolley generally designated by the numeral 26 including rollers 28 which ride on the bridge 14.

Figure 3:
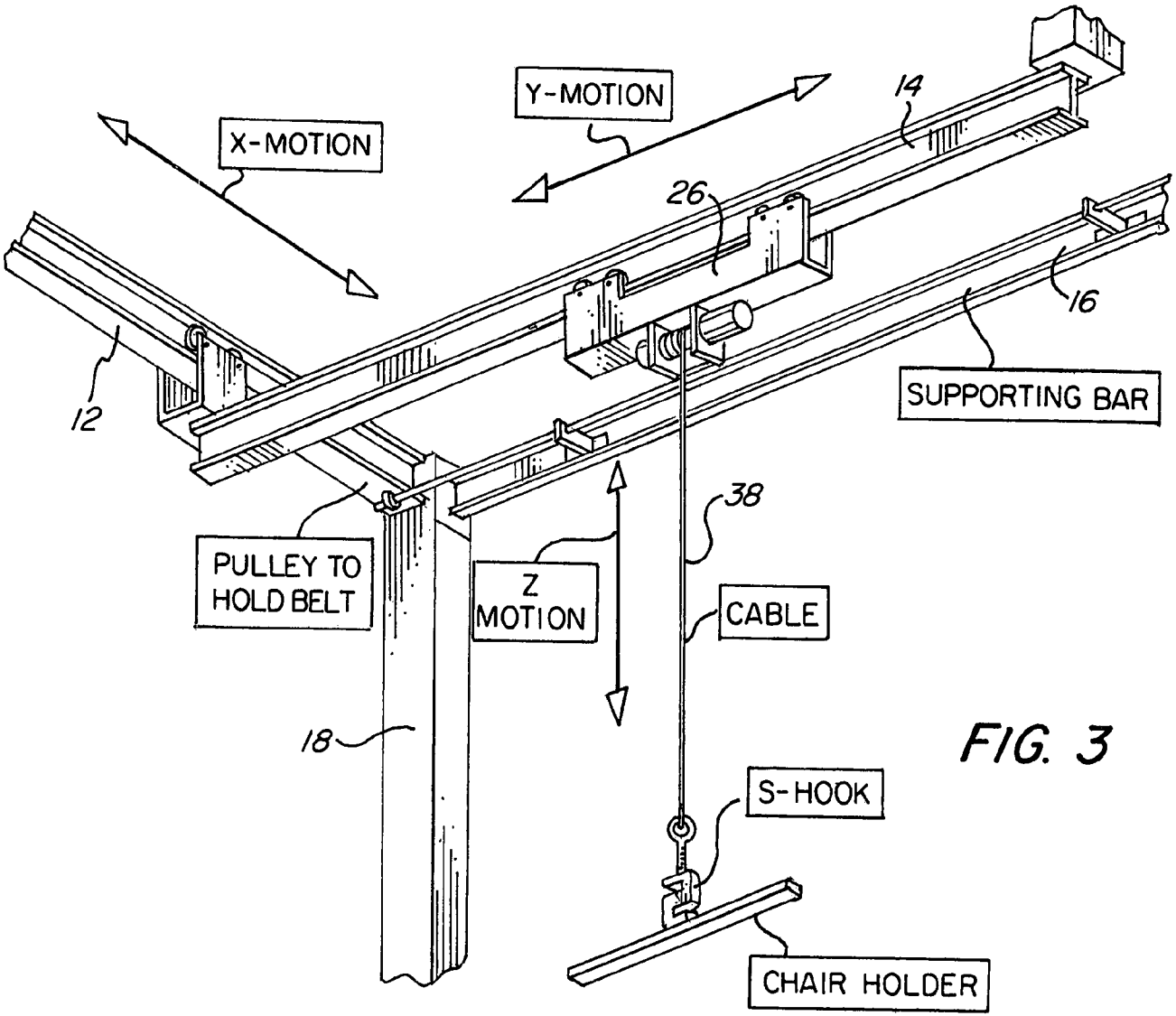
FIG. 3 is a fragmentary perspective view of a corner of the framework, trolley and cable support of FIG. 2.

As seen in FIG. 3, the trolley 26 has a hoist 32 and a motor 34. A cable 38 is wound about the hoist 32 and the depending cable 38 carries a load cell force sensor assembly 30.

The cable 38 carries the harness or jacket 40 in which the patient is secured. An XY tilt sensor 36 on the cable 38 senses the direction of the movement of the patient. A bidirectional motor 44 on the rail 12 and the belt drive 45 move the bridge 14 along the rails 12 (X direction) and a bidirectional motor 50 and belt drive 51 on the bridge 14 move the trolley 26 on the bridge 14 (Y direction). A transmission shaft 62 provides a drive connection to the belt 51 to ensure that the ends of the bridge 14 move in parallel. The movement of the bridge 14 on the rails 12, 12 and the movement of the trolley 26 on the bridge 14 are at the speed and in the direction of movement of the patient so that the patient does not encounter resistance from the mass of the support elements. In addition, a load cell 52 senses a falling patient and operates the hoist 32 to limit the fall and support the patient. Limit switches 63 on the bridge limit the motion of the trolley 24 and limit switches 64 on the rails 12 limit the movement of the bridge 24 on the rails 12.

Figure 4:
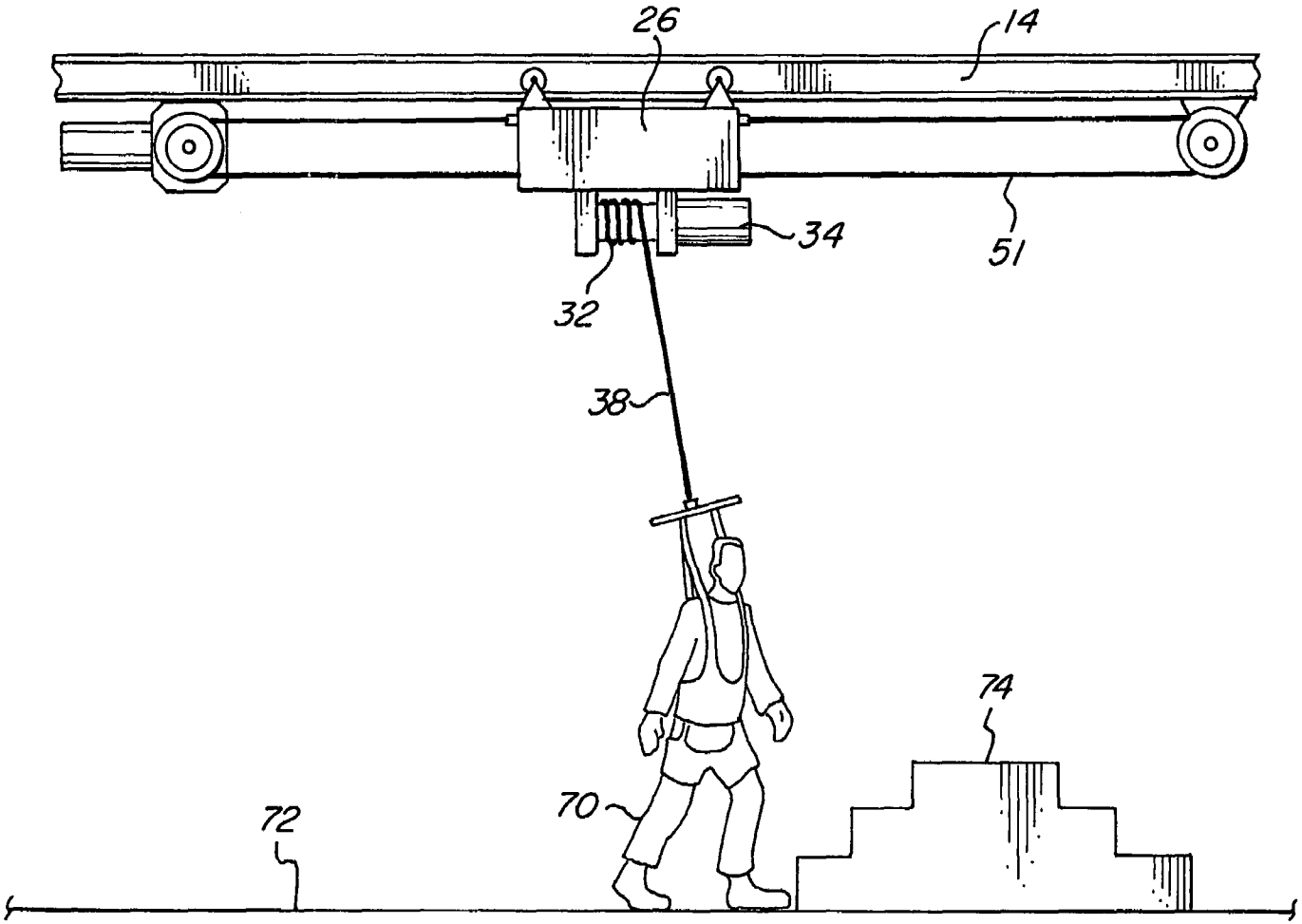
FIG. 4 is a diagrammatic illustration of a patient in the harness and ambulatory movement towards a set of steps.
Figure 5B:
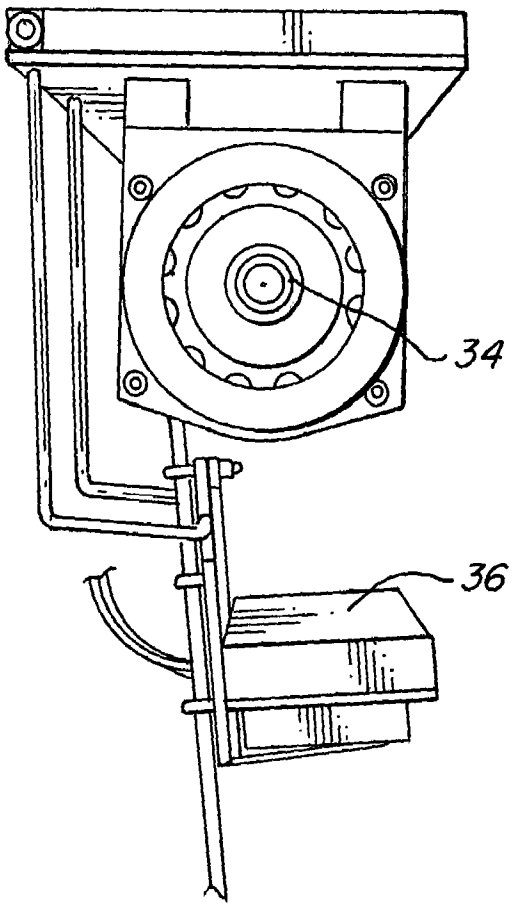
FIGS. 5*a* and 5*b* are, respectively, front and side elevational views of the tilt sensor, its support and the cable hoist.
Figure 5A:
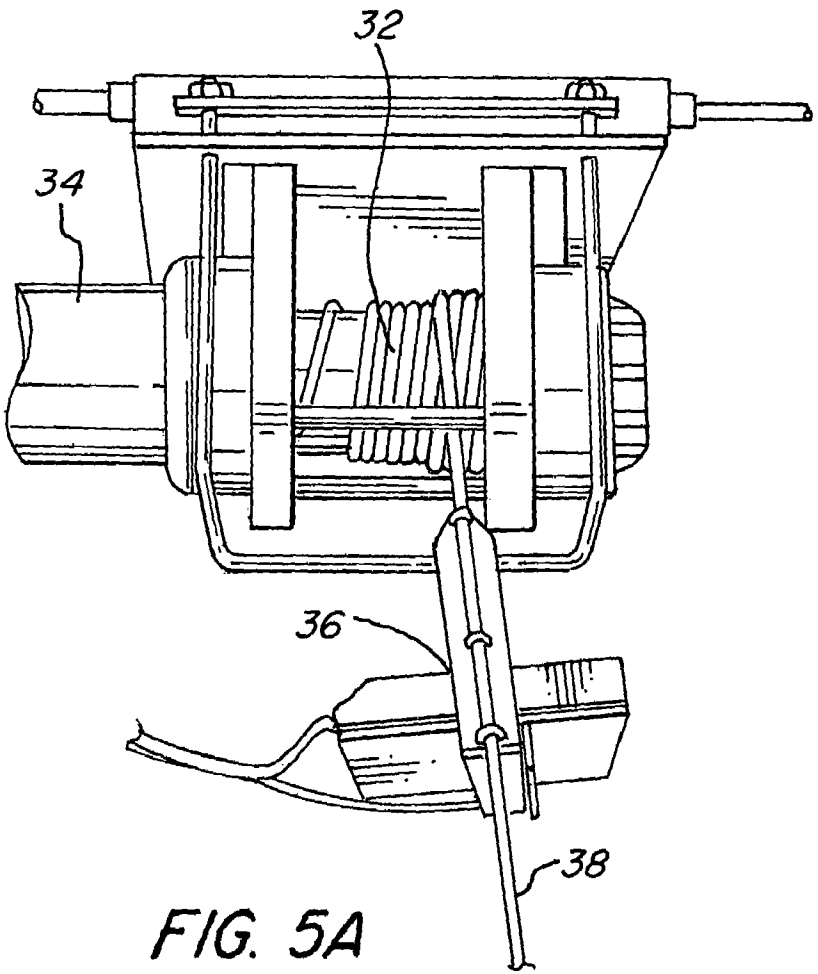

As a result, and as seen in FIG. 4, the patient 70 can move along the surfaces of the floor 72 and the cable 38 will be wound around the drum of the hoist 32 as he climbs the stairs 74 and unwinds as the patient 70 descends the stairs 74 to maintain a substantially uniform level of support (and unweighting) for the patient 70.

The system utilizes three variable speed motors 34, 44, 50 that dynamically track the position of the patient in a combination with the custom built electronic sensors. The controlled variable for the Z-axis (vertical force or tension) is measured with the load cell 52 and a bridge amplifier assembly (not shown). The X and Y-axis controlled variables (direction of motion) is sensed with the custom built accelerometer based tilt sensor 36 and a custom built feed back amplifier assembly (not shown).

Figure 6:
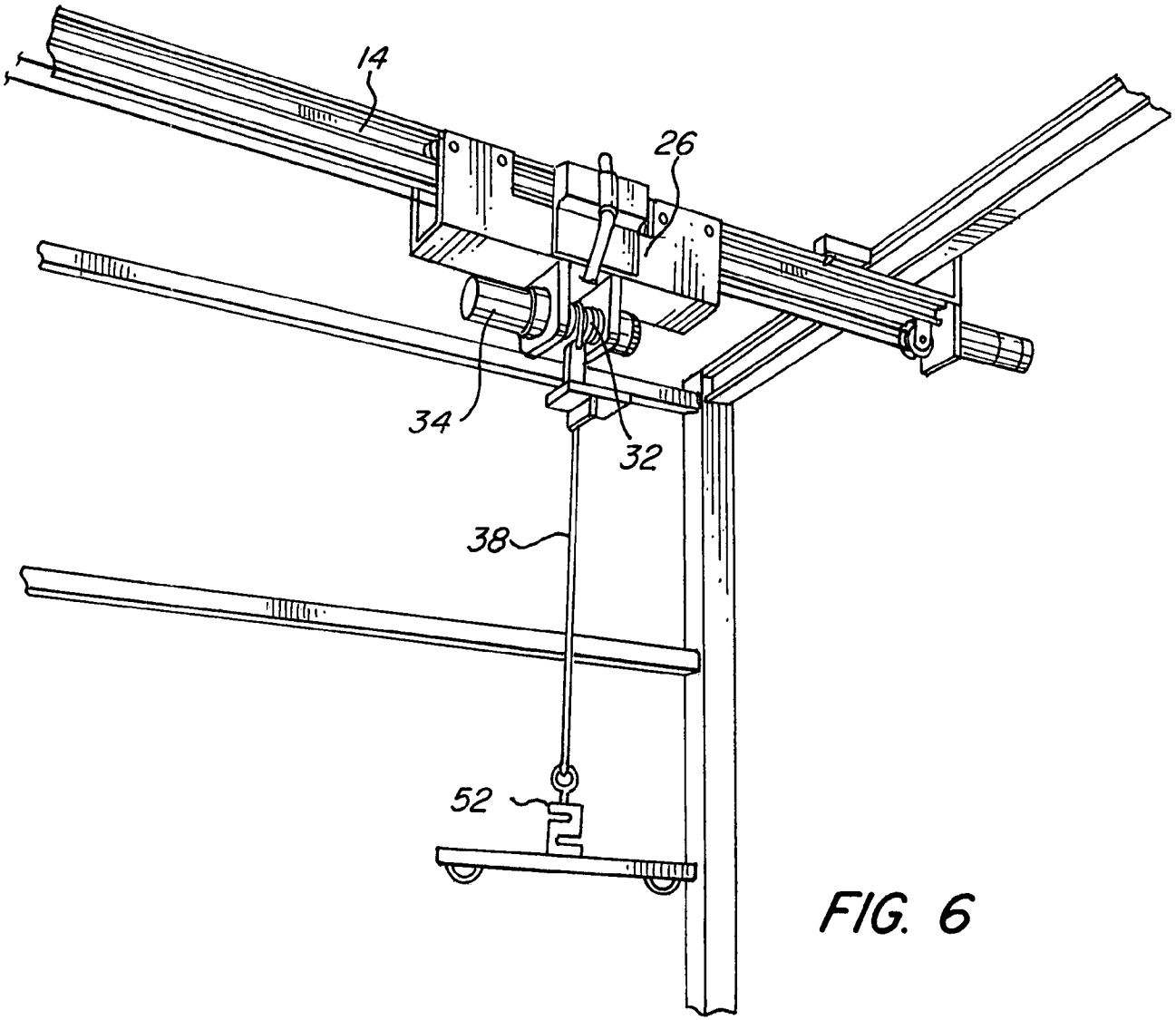
FIG. 6 is a perspective view of the apparatus showing the principal elements of the Z-axis control system.

In FIG. 6, the z-axis control system comprises the trolley 26 with the hoist 32 and the cable 38 supports the tilt sensor 42 and the load cell 52.

Figure 7:
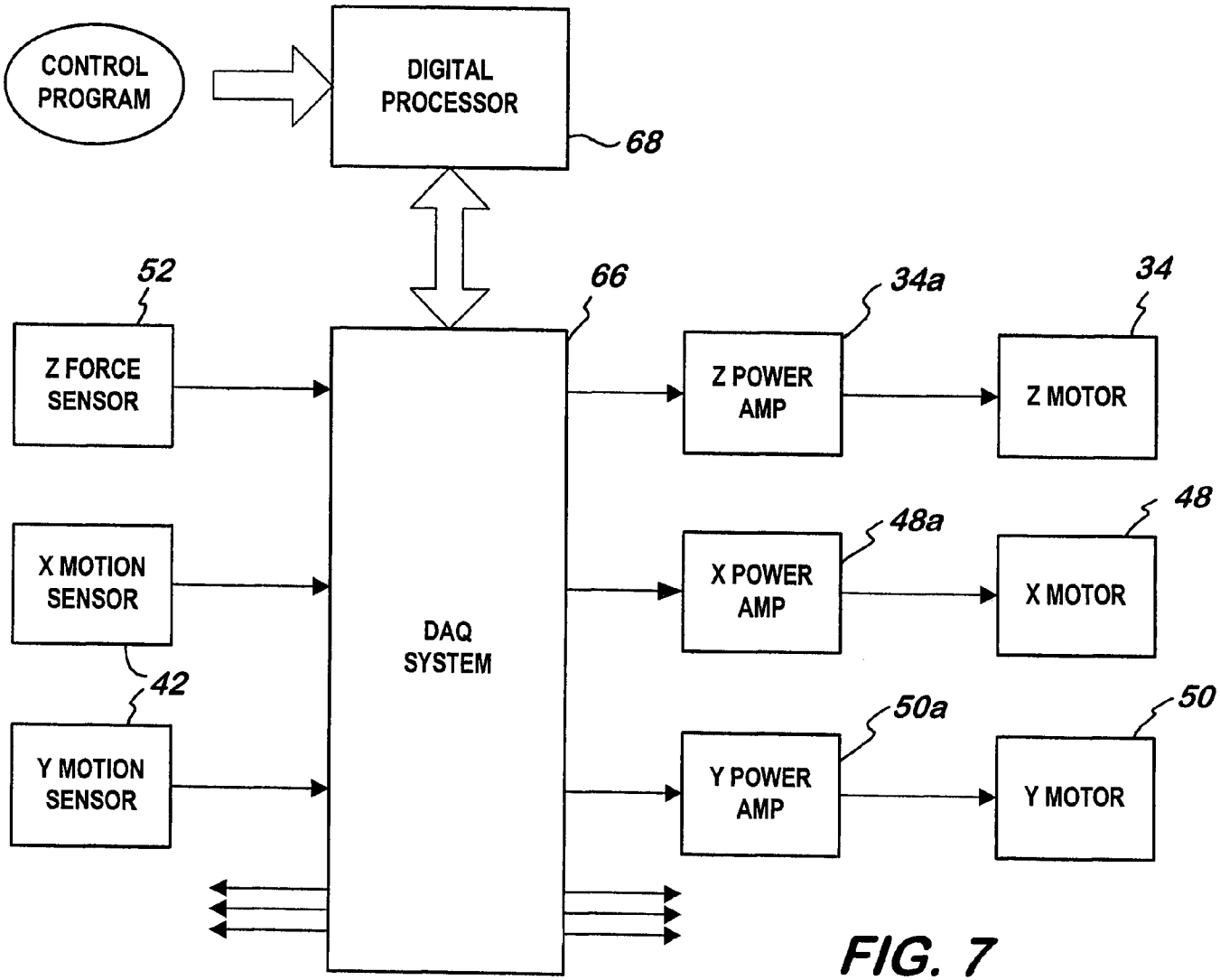
FIG. 7 is a block diagram of the principal elements of the XYZ control system.

In FIG. 7, the XYZ-axis control system is comprised of the interface board 66 and the digital processor 68 which are receiving signals from the x and Y tilt sensor 42 and the load sensor 30 and outputting power to the several motors 34, 48, 50 through the power amplifiers 34*a*, 48*a* and 50*a*.

Figure 8:
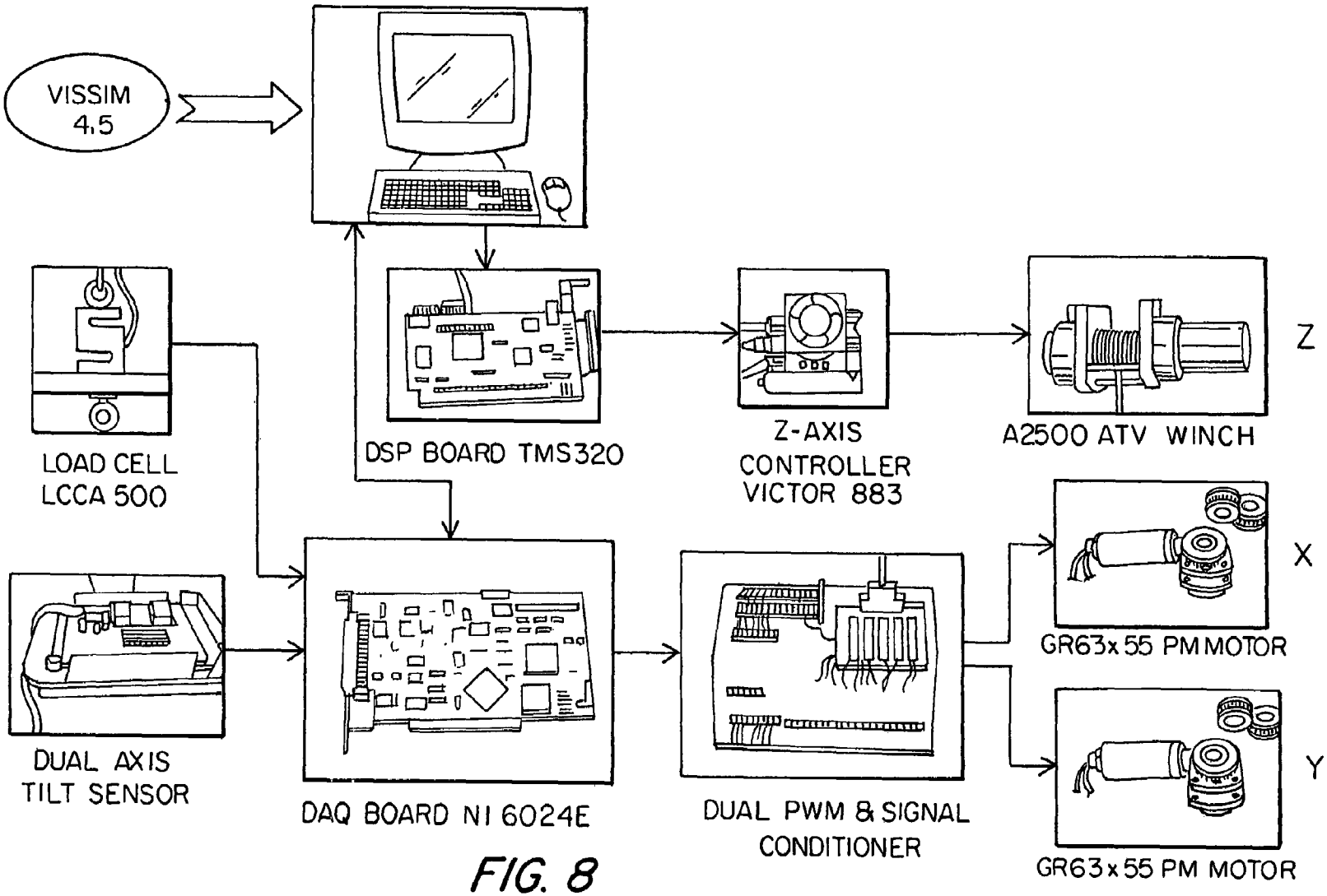
FIG. 8 is a block diagram of the principal hardware and digital components for one implementation of the XYZ-axis control system.

FIG. 8 illustrates a collection of specific components for the system of FIG. 7.

Figure 9:
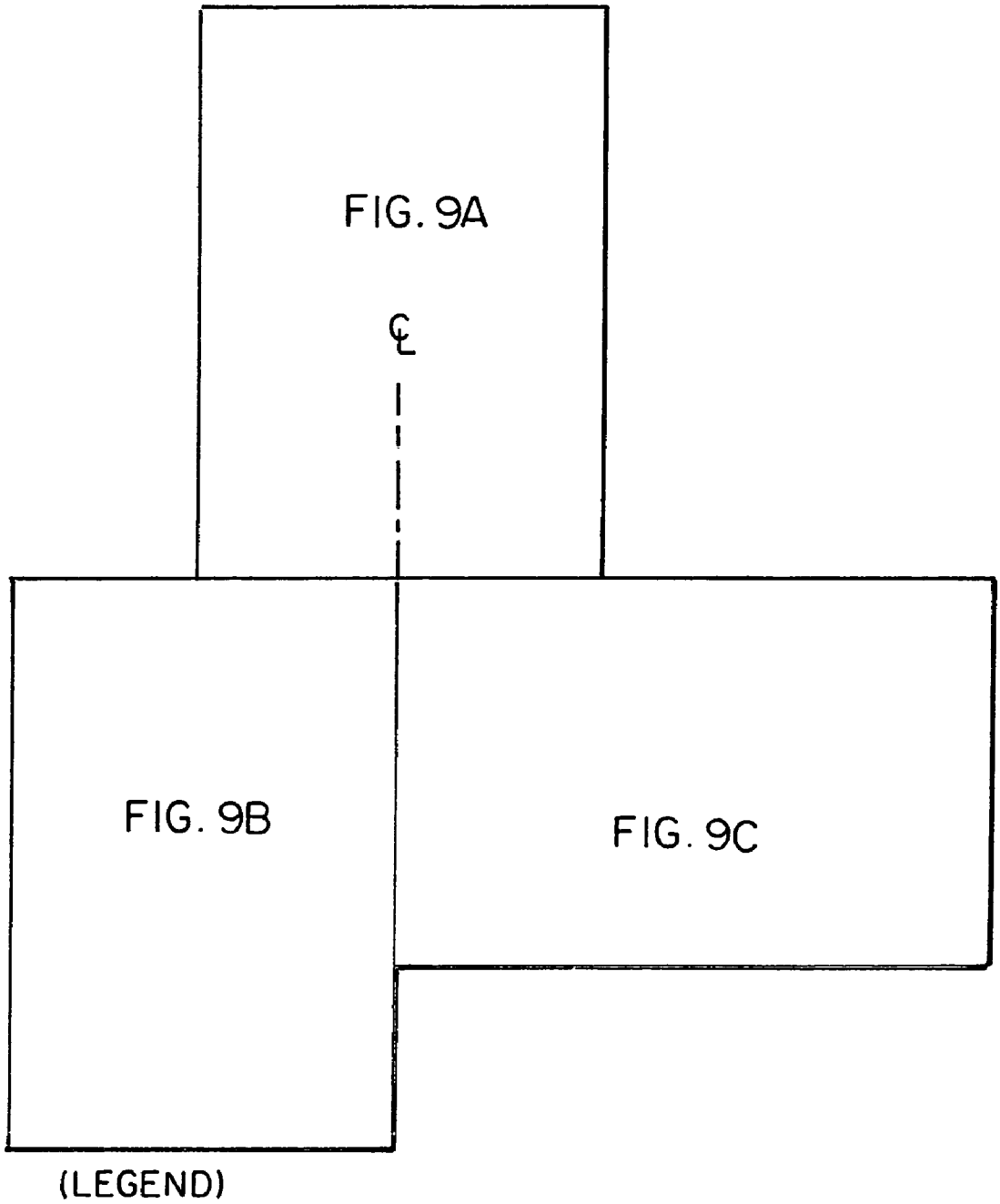
FIG. 9 is an operational flow chart for the software of an ambulatory suspension system embodying the present invention.
Figure 9A:
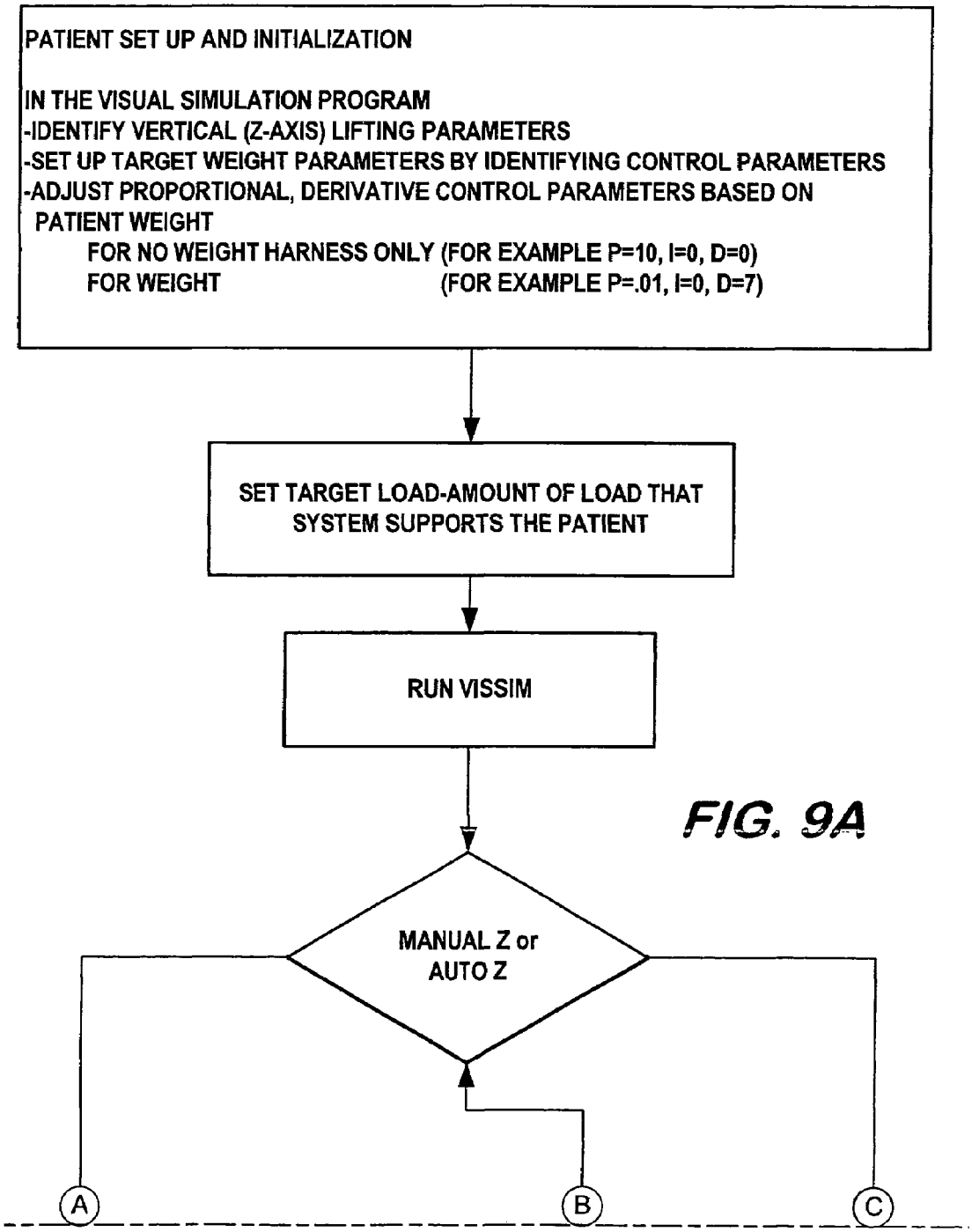
Figure 9B:
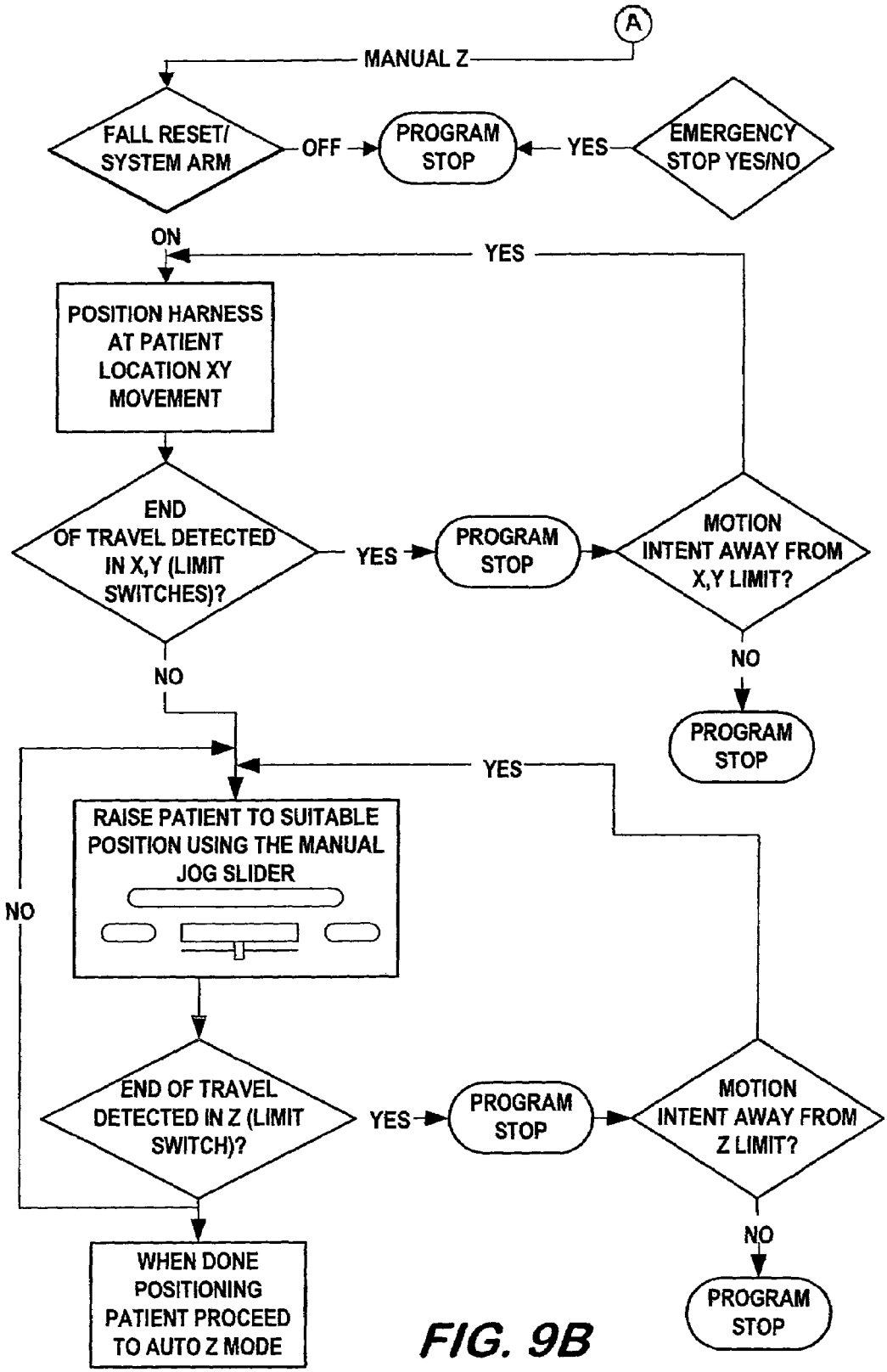
Figure 9C:
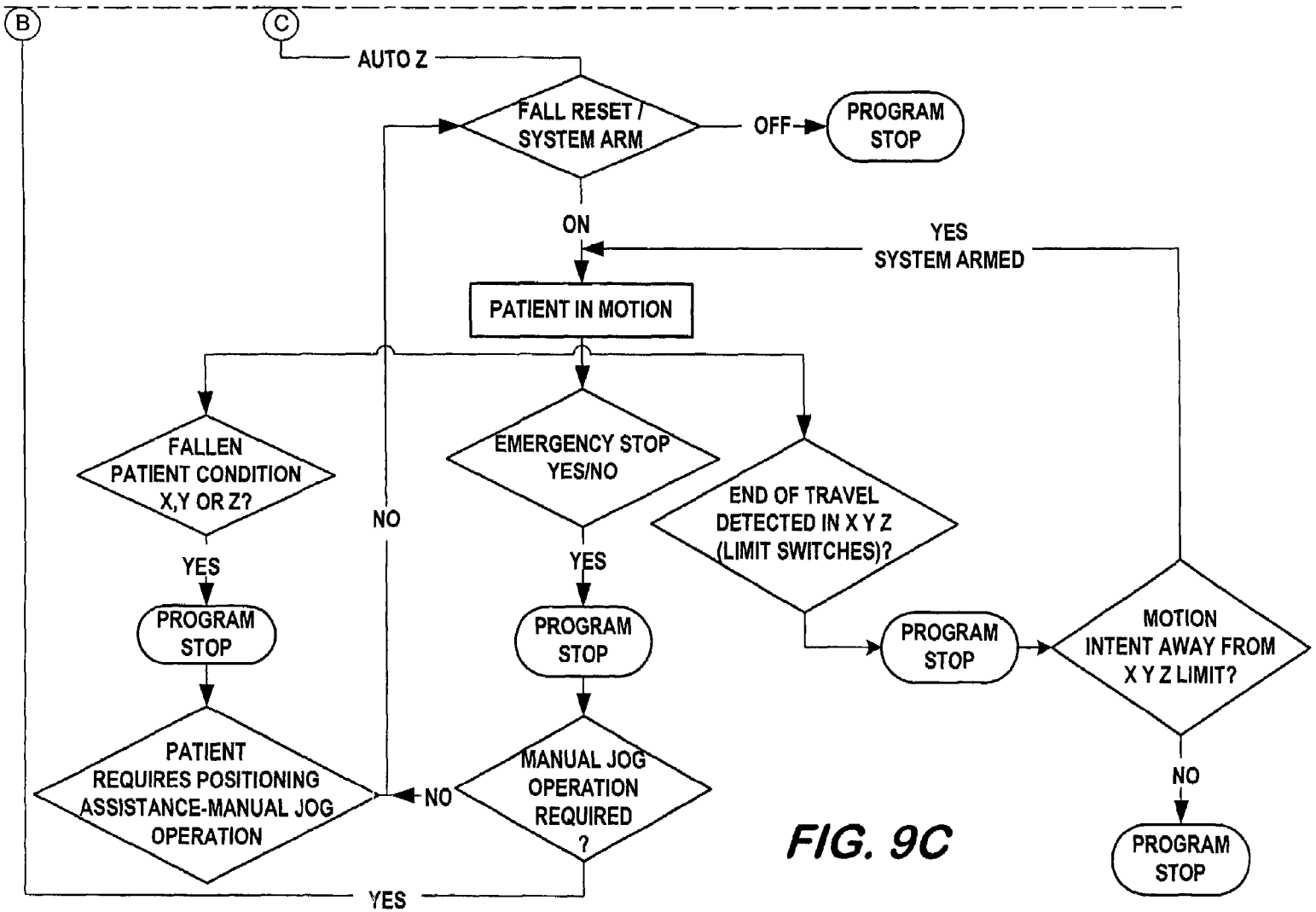

Turning next to FIG. 9, a flow chart of software for the ambulatory suspension system is illustrated. As indicated, the therapist initially sets the parameters for the patient and can run a simulation if so desired. The Z-axis control may be manual or automatic with the manual control. In either case, if the patient starts to fall, the therapist or the software stops the running of the program and the patient's position is thereafter adjusted before the operation is restarted.

Figure 10:
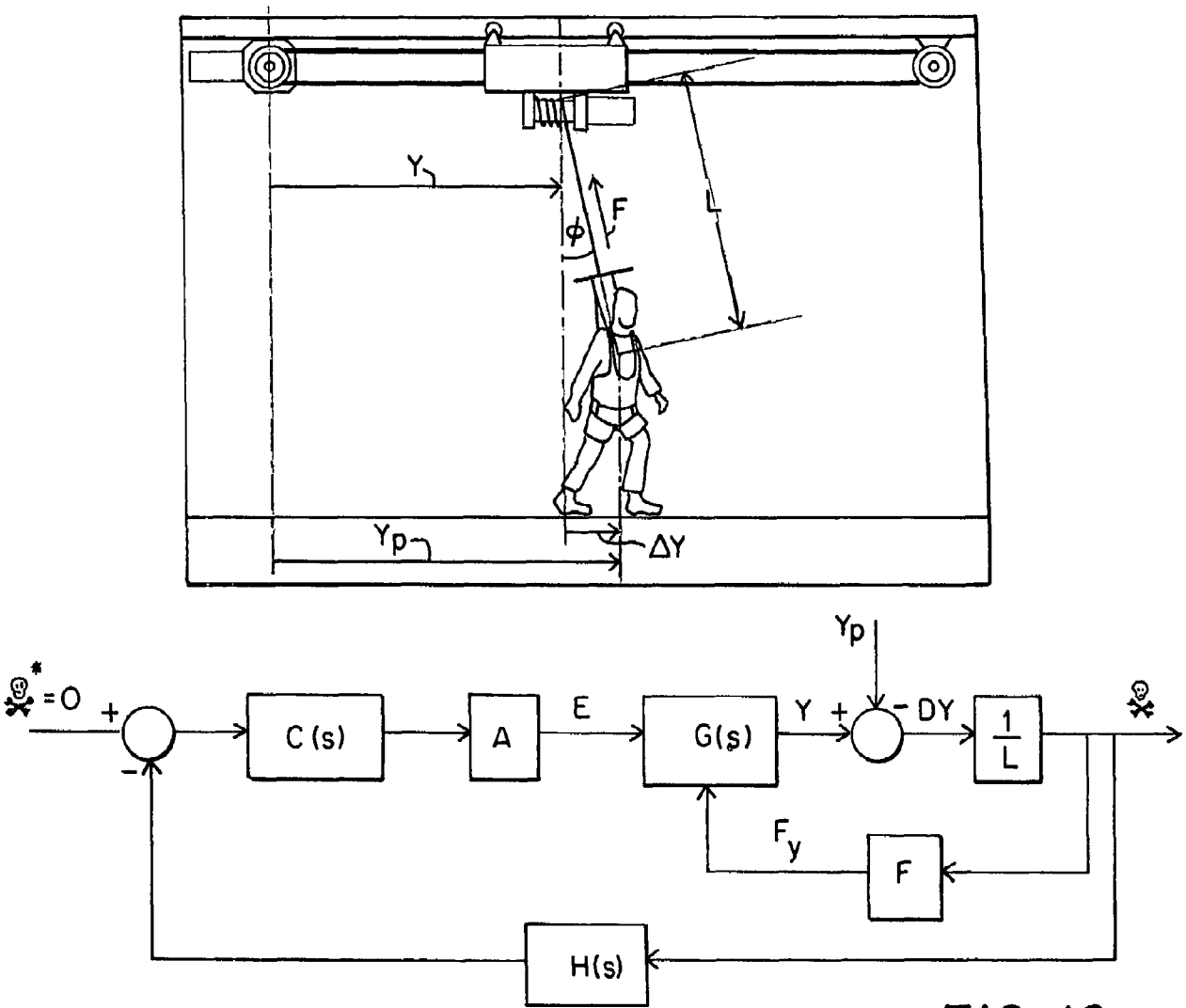
FIG. 10 is a diagrammatic illustration of the Y-axis closed loop system.

FIG. 10 is a diagrammatic illustration of a patient 70 moving along the floor and showing the several factors which are utilized to maintain the included angle between the patient and trolley close to 0.

Figure 11A:
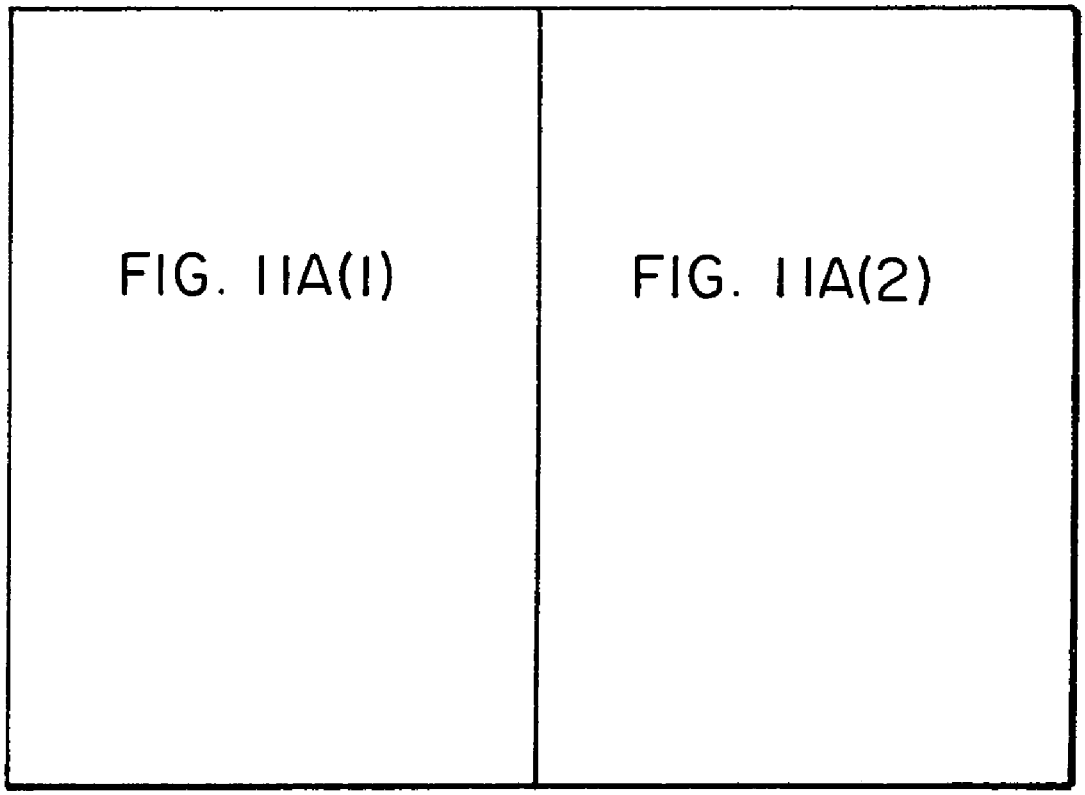
FIGS. 11A, 11B and 11C are flow charts of modules in the software flow chart of FIG. 9.
Figure 11B:
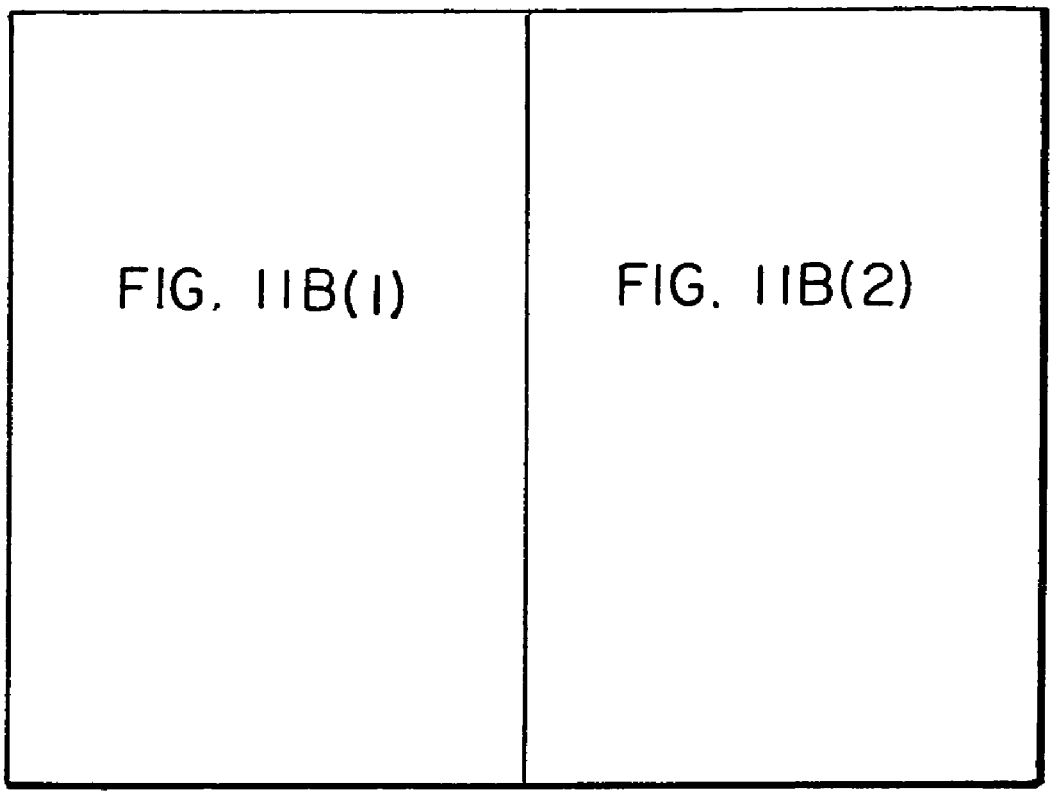
Figure 11C:
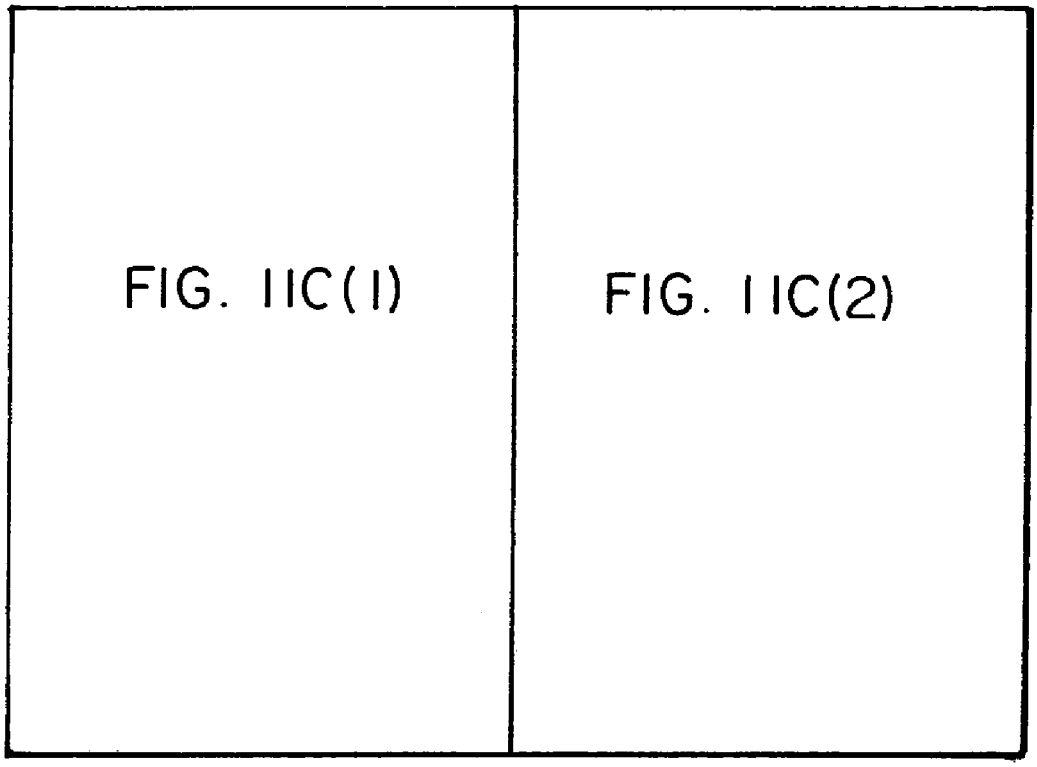

FIG. 11A is a detailed flow chart of the module for controlling the Z-axis motion while FIG. 11B is a detailed flow chart of the module for the XY axis motion; and FIG. 11C is a detailed flow chart of a position of the module of 11B.

The conditioned signals from the sensors are output to a data acquisition interface board which collects analog and digital input information and passes the information to the microprocessor through a parallel port. The microprocessor utilizes a visual simulation program to process the inputs and provide the appropriate outputs through custom built control algorithms that are integrated into a common control system. The control system outputs a control signal to each of the three variable speed pulse width modulated (PWM) power control modules. The pulse width modulated power passes through current limiting devices to the drive motors, which are positioned at the appropriate locations to support the patient as he or she progresses through physical therapy exercises.

The control system includes manual and automatic control sequences as well as an emergency mode which utilizes "smart sensing" to determine when a patient falls or loses control of his or her balance; generally, an abrupt motion. The control system then stops, locking the position of the three DC motors and thereby supporting the patient until the therapist can assist the patient.

The force feedback control system is the logical choice when considering the design criteria. The control system design included a Proportional Integral Derivative (PID) control strategy.

The hardware that communicates with the PWM control, consists of the following:

Digital Signal Processing (DSP) Rapid Proto-typing development board

Pulse Width Modulating DC Motor Speed Controller

Real time system stimulation and control software contains algorithms necessary to control the output of the Digital Signal Processing (DSP) rapid proto-typing board. The control signal that interfaces the two components is pulse width modulation control (PWM). The Z-axis motor is modulated with a commercially available speed control device: the PWM controller is designed for a standard RC pulse width modulating input signal that consists of a 5 volt DC pulse train with a 17 millisecond period and a pulse width of 1-2 milliseconds. The speed controller is designed to interpret the range of pulse widths as follows: 1 ms pulse=full reverse, 1.5 ms pulse=neutral, 2 ms pulse=full forward speed.

Pulse width modulation (PWM) is a potent method for controlling analog circuits with a microprocessor digital output. PWM is a method of encoding a precise numeric value on a digital or pulse waveform by changing the duty cycle or width of individual pulses. A PWM control signal remains digital continuously from the processor to the controlled system. Since no analog to digital signal conversion is necessary, signal accuracy is maintained and the digital number is communicated precisely.

A discrete or digital signal is less affected by electrical noise than an analog signal because the signal can only be compromised if the noise is potent enough to change the pulse from the "On" or peak voltage level to the "Off" or zero voltage level. An analog signal is interpreted by the magnitude of its voltage or current and can be altered by induction, lead wire loss and ground loops. Digital signals are often used for communications because they require less power to transmit than equivalent analog signals and are less susceptible to noise.

Pulse width modulation is not only a method of communicating the control signal, but also it is a way to efficiently control motor speed. A PWM signal is generated at the peak design voltage of the motor being controlled and the speed of the motor is varied by modulating the percent of the time or duty cycle that the pulse is "On" or at the full voltage level. By varying the duty cycle of the power entering the motor, the average voltage over a fixed unit of time is reduced and a variable amount of power is transferred to the motor. The speed of the motor is reduced in proportion to the duty cycle of the PWM waveform supplied to the motor.

A constant speed reversible DC electric hoist is used. This hoist is designed to deliver significant force at a relatively high speed and power. In order to develop high pulling capacity, the hoist contains a gearbox which converts the high speed and low torque output of the motor into a high torque low line speed output.

Since the gears are selected for a high reduction ratio, the gearbox is essentially self locking; when the motor is de-energized applying a load to the cable will not cause the capstan to revolve. This is an ideal feature for this application in that it simplifies the fall prevention control mechanism. When a patient fall is detected, the motor is simply de-energized and the patient is supported until the control system is reset.

The hoist is conveniently designed with a 0.09 hp 12-volt permanent magnet DC motor. The motor's rotational speed is reduced and its torque increased by a 3-stage planetary gear train transmission with an overall gear ratio of 136 to 1. The design of the gear train is self-locking; therefore, applying tension on the output cable cannot cause the motor to rotate.

The control system utilizes closed loop proportional derivative (PD) control algorithms to control the speed and direction of the hoist motor control signal. The controlled variable is the tension in the cable providing support to the patient; the magnitude of the cable tension is measured using an S type load cell.

The load cell is a device that converts mechanical load either in tension or compression into a variable electrical resistance. Typically, the resistance is arranged with three other electrical resistors in a series parallel arrangement commonly referred to as a Wheatstone bridge. The fixed resistors provide temperature compensation since they are commonly selected with temperature vs. resistance characteristics that are similar to the strain resistor.

The illustrated system acts as an automated support structure for patients by providing support in a full range of motion, thus allowing ambulatory impaired patients to safely rehabilitate themselves under the supervision of a physical therapist.

The apparatus also functions as an adjustable gait rehabilitation lifting system and has the ability to support the weight of the user. The apparatus can lift a patient from a sitting position in a wheel chair to a standing position and has the ability to remove a percentage of the patient's body weight and recognize subtle changes in elevation. The patients requiring gait rehabilitation are free to traverse in a planar area and climb a number of stairs. At the same time, it does not impede free walking, but has the ability to prevent sudden falls.

The XY motion system consists of an XY-axis drive train, custom designed XY accelerometer tilt sensors, and a custom interface electronics package. The custom electronics package provides control system power supply, signal conditioning for the tilt sensors, and pulse width modulated variable speed control output signals for the XY variable speed motor.

The Z motion system consists of a Z-axis force feed back closed loop control system comprised of:

- Load cell force sensor
- Load cell force sensor power supply and signal conditioner
- Pulse width modulated variable speed dc motor control module
- Electric hoist
- Computer interface data acquisition circuitry board
- Custom control system programming The control program is developed using visual simulation control diagrams combined into one diagram and sharing common interface hardware.

By arranging the resistors in a Wheatstone Bridge configuration and applying a suitable excitation voltage to the load cell terminals from terminals B+ and B−, as strain is applied to the strain sensing resistor, a variable voltage can be measured across the terminals and load due to the resulting change in voltage drop across the strain sensitive resistor and the imbalanced resistance in the bridge circuit.

The hardware for the control system may be readily available commercial components selected to reduce cost while providing suitable functionality. The component list for the vertical support system consists of the following:

- Personal computer
- Tilt sensor
- Beam Load Cell
- Signal Amplifier and Power Supply
- Pulse Width Modulating DC Motor Speed Controller
- Data Acquisition Board
- Hoist Assembly The fall prevention criteria for the system may be implemented on several levels.

- The Z-Axis force feed back control loop is designed with an integral method of capturing a patient during a sudden fall. The force measuring system contains a control algorithm that senses the rate of change of a measured variable and locks the system at a fixed position if the rate of change exceeds the adjustable prescribed limit. This allows discrimination of a fall from movement on stairs. The algorithm must be manually reset before the automated support algorithms can resume their automated functions.
- The XY-Axis force feed back control loop is designed with an integral method of capturing a patient during a sudden fall. The force measuring system contains a control algorithm that senses the rate of change of the measured variables and locks the system at a fixed position if the rate of change exceeds the adjustable prescribed limit. The algorithm must be manually reset before the automated support algorithms can resume their automated functions.

An Emergency Stop button is provided to allow the patient or attendant to stop the automated process and lock the position of the patient if an unsafe condition is detected.

The Z-Axis lifting mechanism is selected with a three stage planetary gear train that is inherently self-locking and prevents a patient from falling in the event of a power failure.

Thus, it can be seen from the foregoing detailed description and attached drawings that the rehabilitation system of the present invention assists the patient to traverse in a plane as well as to climb up and down stairs. This allows patients to gain strength and confidence by offsetting a percentage of their body mass and providing external balance support, which permits walking of patients during early states of neurological recovery.

The system permits direct physical interaction between a person and a general purpose manipulator controlled by a computer.

The system may be fully automated under normal conditions and does not require continuous patient supervision after initial equipment setup. A remote panic button may instantly stop and lock the position of the support system in the event of a system failure.

Thus, it can be seen from the foregoing detailed specification and attached drawings that the ambulatory suspension system of the present invention is relatively simple to fabricate, highly effective in unweighting the patient, responsive to movement in X, Y and Z directions, and rapid in limiting any fall.

Having thus described the invention, what is claimed is:

1. An ambulatory suspension system for gait rehabilitation including:

(a) a parallel pair of rails bordering the sides of and spaced above a training area;

(b) a bridge extending between and movable along said rails;

(c) trolley movable along said bridge;

(d) a motor driven hoist on said trolley;

(e) a cable extending about said hoist and depending from said trolley, said hoist being operable to vary the length of the cable depending from said trolley;

(f) a harness suspended on said cable;

(g) motors for moving said bridge along said rails and said trolley along said bridge;

(h) sensors for sensing the direction of movement of the patient in X and Y directions;

(i) a sensor on said cable for sensing the falling motion of a patient supported in said harness;

(j) a computer control for receiving signals from said sensors and operating said motors to move said bridge on said rails and said trolley on said bridge and to rotate said hoist to provide movable support for the patient in said harness within the training area.

2. The ambulatory suspension system in accordance with claim 1 wherein said X and Y direction sensors are provided by a dual axis tilt angle sensor.

3. The ambulatory suspension system in accordance with claim 2 wherein said tilt angle sensor is supported on said depending cable.

4. The ambulatory suspension system in accordance with claim 1 wherein said falling motion sensor is a load cell.

5. The ambulatory suspension system in accordance with claim 1 wherein said motor for moving said bridge drives a belt extending along one of said rails.

6. The ambulatory suspension system in accordance with claim 5 wherein a second drive belt extends along the other of said rails and a transmission couples said belts to effect simultaneous motion of said belts and thereby both ends of said bridge.

7. The ambulatory suspension system in accordance with claim 1 wherein said falling sensor also maintains a desired load for unweighting the patient.

8. The ambulatory suspension system in accordance with claim 2 wherein said computer responds to the patient's movement in X and Y directions and effects the intended unweighting in the Z direction.

9. The ambulatory suspension system in accordance with claim 1 wherein there is included a remote panic button to instantly stop and lock the system and position of the patient support in the event of a system failure.

10. The ambulatory suspension system in accordance with claim 1 where the computer control defaults to a locked position in the event of a power failure so that the patient does not fall.

11. The ambulatory suspension system in accordance with claim 1 wherein the computer control includes a memory which stores patient data as well as the requirements of the patient's training program.

12. The ambulatory suspension system in accordance with claim 11 wherein said computer control is fully automated under normal conditions and does not require continuous patient supervision after initial equipment setup.

13. The ambulatory suspension system in accordance with claim 12 wherein the computer control is responsive to input from the falling motion sensor to maintain essentially the same unweighting of the patient during movement up and down stairs.

14. The ambulatory suspension system in accordance with claim 1 wherein the drive motor for said trolley is engaged with a drive belt extending along the length of the bridge.

15. The ambulatory suspension system in accordance with claim 1 wherein said computer control receives signals from said sensors, processes the signals and powers said motors.

16. The ambulatory suspension system in accordance with claim 15 wherein said motors are powered so that the trolley and bridge move with the patient to maintain a substantially perpendicular orientation between said depending cable and trolley.

17. An ambulatory suspension system for gait rehabilitation including:

(a) a parallel pair of rails bordering the sides of and spaced above a training area;

(b) a bridge extending between and movable along said rails;

(c) trolley movable along said bridge;

(d) a motor driven hoist on said trolley;

(e) a cable extending about said hoist and depending from said trolley, said hoist being operable to vary the length of the cable depending from said trolley;

(f) a harness suspended on said cable;

(g) motors for moving said bridge along said rails and said trolley along said bridge;

(h) a tilt sensor on the cable for sensing the direction of movement of the patient in X and Y directions;

(i) a load cell sensor on said cable for sensing the falling motion of a patient supported in said harness and for maintaining a desired load for unweighting the patient;

(j) a computer control for receiving signals from said sensors and operating said motors to move said bridge on said rails and said trolley on said bridge and to rotate said hoist to provide movable support for the patient in said harness within the training area; and said computer control responds to the patient's movement in X and Y directions and the intended unweighting in the Z direction.

18. The ambulatory suspension system in accordance with claim 17 wherein the computer control includes a memory which stores patient data as well as the requirements of the patient's training program.

19. The ambulatory suspension system in accordance with claim 17 wherein said computer control is fully automated under normal conditions and does not require continuous patient supervision after initial equipment setup.

20. The ambulatory suspension system in accordance with claim 17 wherein the computer control is responsive to input from the falling motion sensor to maintain essentially the same unweighting of the patient during movement up and down stairs.

* * * * *